US006702017B1

(12) United States Patent
Corrigan et al.

(10) Patent No.: US 6,702,017 B1
(45) Date of Patent: Mar. 9, 2004

(54) APPARATUS AND METHOD FOR WELL FLUID SAMPLING

(75) Inventors: Neil David Corrigan, Aberdeen (GB); Quentin Peter William Morgan, Juala Belait (BN); William Lawson Smith, Reading (GB)

(73) Assignee: Expro North Sea Limited, Aberdeen (GB)

( * ) Notice: Subject to any disclaimer, the term of this patent is extended or adjusted under 35 U.S.C. 154(b) by 0 days.

(21) Appl. No.: 09/857,863

(22) PCT Filed: Dec. 1, 1999

(86) PCT No.: PCT/GB99/04046

§ 371 (c)(1),
(2), (4) Date: Sep. 24, 2001

(87) PCT Pub. No.: WO00/34624

PCT Pub. Date: Jun. 15, 2000

(30) Foreign Application Priority Data

Dec. 9, 1998 (GB) ..... 9827077

(51) Int. Cl.[7] ..... E21B 49/08; E21B 47/06; E21B 36/04

(52) U.S. Cl. ..... 166/264; 166/60; 166/66; 166/250.4; 175/59; 73/152.28; 73/152.33

(58) Field of Search ..... 166/264, 250.01, 166/386, 65.1, 66, 60, 61; 175/58, 59, 60; 73/152.12, 152.23, 152.28, 152.33

(56) References Cited

U.S. PATENT DOCUMENTS

| | | | | |
|---|---|---|---|---|
| 3,664,178 A | | 5/1972 | Spergel et al. | 73/53 |
| 3,793,887 A | | 2/1974 | Anderson et al. | 73/421 |
| 4,262,533 A | | 4/1981 | Jaeger | 73/422 |
| 4,296,637 A | | 10/1981 | Calamur et al. | 73/863.11 |
| 4,335,620 A | | 6/1982 | Adams | 73/863.11 |
| 4,583,595 A | * | 4/1986 | Czernichow et al. | 166/264 |
| 4,670,219 A | | 6/1987 | Nelson et al. | 422/63 |
| 4,766,955 A | * | 8/1988 | Petermann | 166/167 |
| 5,240,072 A | * | 8/1993 | Schultz et al. | 166/169 |
| 5,322,120 A | * | 6/1994 | B e et al. | 166/264 |
| 5,337,822 A | * | 8/1994 | Massie et al. | 166/264 |
| 5,377,755 A | * | 1/1995 | Michaels et al. | 166/264 |
| 5,473,939 A | * | 12/1995 | Leder et al. | 73/152.12 |
| 5,522,272 A | | 6/1996 | Vecere et al. | 73/864.62 |
| 5,549,162 A | | 8/1996 | Moody et al. | 166/264 |
| 5,901,788 A | | 5/1999 | Brown et al. | 166/264 |
| 5,934,374 A | * | 8/1999 | Hrametz et al. | 106/264 |
| 6,182,753 B1 | * | 2/2001 | Schultz | 166/162 |
| 6,216,782 B1 | * | 4/2001 | Skinner | 166/250.01 |

FOREIGN PATENT DOCUMENTS

| | | |
|---|---|---|
| DE | 3908930 | 10/1990 |
| GB | 2252296 A | 8/1992 |
| GB | 2322846 A | 9/1998 |
| SU | 368390 | 7/1973 |
| SU | 955777 A | 9/1982 |
| SU | 1571461 A | 6/1990 |
| WO | WO8912159 | 12/1989 |
| WO | WO9112411 | 8/1991 |
| WO | WO94006471 | 1/1994 |
| WO | WO9612088 | 4/1996 |
| WO | WO 9612088 A | 4/1996 |

* cited by examiner

*Primary Examiner*—David Bagnell
*Assistant Examiner*—Jennifer H Gay
(74) *Attorney, Agent, or Firm*—Gifford, Krass, Groh, Sprinkle, Anderson & Citkowski, P.C.

(57) ABSTRACT

A well fluid sampling tool (5) having a sample chamber (315) at least partly contained within an at least partially evacuated jacket (160, 165, 170), the outermost wall (160) of the jacket (160, 165, 170) being adjacent to or forming an outermost wall of the tool (5). In such a tool (5) the evacuated jacket (160, 165, 170) acts to maintain the sample as originally retrieved, e.g. in single phase form (at original temperature).

46 Claims, 15 Drawing Sheets

APPARATUS AND METHOD FOR WELL FLUID SAMPLING

FIELD OF THE INVENTION

This invention relates to a well fluid sampling tool and to a well fluid sampling method.

The invention particularly, though not exclusively, relates to a so-called single phase or monophasic sampling tool, and related method.

BACKGROUND OF THE INVENTION

There are many circumstances where it is desirable to sample a fluid material, whether as a gas, a liquid, or a mixture of the two, and determine its nature, for example, its physical and chemical composition, to determine information about the body of fluid from which the sample was taken. On some such occasions the sample may be obtained under one set of ambient conditions—of pressure and temperature, say—and thereafter removed to a quite different set for analysis such that, if unprotected, the sample's state—e.g. its physical and chemical form—may change during this removal until it is no longer sufficiently representative of the original fluid. One typical example of this situation occurs when sampling fluids issuing from geological formations into which a well, such as an oil/gas well, has been drilled. At the bottom of the well, which may be several miles deep, pressure and temperature are high—possibly several hundred atmospheres, and in the low hundreds of degrees Celsius. Whilst the formation fluid may under these ambient conditions be a single phase fluid, nevertheless a sample of this fluid transported to quite different ambient conditions of the surface (specifically of pressure and temperature—often referred to as NAP, Normal Atmospheric Pressure, or as NTP, Normal Temperature and Pressure), where it is to be analysed to reveal useful information about the well, may easily separate into two or more distinct phases—for example, a liquid phase, a gas phase (originally dissolved in the liquid), and a solid phase (originally suspended or in solution in the liquid).

As such, the separated sample is no longer truly representative of the original fluid—or, at least, not in an easily-understood way—and so has lost much of its value. Indeed in some circumstances it may be impractical to reconstitute the original fluid sampled.

Single phase sampling tools are known. For example, WO 91/12411 (OILPHASE SAMPLING SERVICES) discloses a well is fluid sampling tool and method for retrieving single-phase hydrocarbon samples from deep wells. In that document the sampling tool is lowered to the required depth, an internal sample chamber is opened to admit well fluid at a controlled rate, and the sample chamber is then automatically sealed. The well fluid sample is subjected to a high pressure to keep the sample in its original single-phase form until it can be analysed. The sample is pressurised by a hydraulically-driven floating piston powered by high-pressure gas acting on another floating piston. Once sampling is initiated e.g. by an internal clock, the entire sequence is automatic.

GB 2 252 296A (EXAL SAMPLING SERVICES) discloses an arrangement which is pressure compensated, so that as the container is lifted to the surface, and the ambient pressure and temperature drop, firstly the sample itself is sealed off to prevent it expanding (and separating) under the reduced pressure, and secondly the original ambient pressure is positively maintained despite any temperature change seeking to cause a corresponding pressure change (so that temperature-induced pressure drop and phase separation is avoided). This end is attained by a sampler wherein the sample chamber, in which the sample itself is received and stored, is sealingly closed at one end by a moveable partition to the other side of which is applied either directly or indirectly (via a buffer fluid) a source of suitably pressured gas.

The aforementioned sampling tools essentially use compensation techniques, i.e. the pressurised gases act on the sample to compensate for pressure drop in the sample due to temperature drop. These sampling tools, therefore, require the provision of a gas reservoir and complicated mechanisms to apply pressure to the sample to compensate for temperature reduction induced pressure changes.

SU 368 390 (MAMUNA et al) discloses a device for withdrawing samples of formation oil, including a body, a receiving chamber with a piston, and an inlet valve, wherein the receiving chamber is fitted with an electric heater connected to a thermometer mounted in the piston, with the aim of preserving the properties of the formation oil in the sample withdrawn.

WO96/12088 (OILPHASE SAMPLING SERVICES) discloses a well fluid sampling tool and method for retrieving reservoir fluid samples from deep wells. In this document the sampling tool is lowered to the required depth, an internal sample chamber is opened to admit well fluid at a controlled rate, and the sample chamber is then automatically sealed. The temperature of the sampled well fluid is maintained at or near initial as sampled temperature to avoid the volumetric shrinkage otherwise induced by temperature reduction, mitigate precipitation of compounds from the sample, and/or maintain the initial single phase condition of the sample. The sample chamber is thermally insulated, provided with a storage heater, electrically heated, given a high heat capacity, and/or pre-heated to sample temperature.

A problem with prior art single phase sampling tools is that the tool must be lowered, in use, down within a is drillstring. The tool must, therefore, be of less than a predetermined outer diameter. However, the tool should also be as short as possible, for example, to seek to avoid the tool becoming stuck or "hanging-up" within the drillstring.

It is an object of at least one aspect of the present invention to obviate or mitigate one or more of the aforementioned problems in the prior art.

It is a further object of at least one aspect of the present invention to seek to provide an optimum sized sample chamber within a tool of particular outer dimensions (outer diameter and length).

SUMMARY OF THE INVENTION

These objects are addressed by the general solution of providing a well fluid sampling tool with an evacuated chamber surrounding at least part of a sample chamber, an outer wall of the evacuated chamber being adjacent to or preferably forming an outer wall of the tool.

According to a first aspect of the present invention there is provided a well fluid sampling tool having, at least in use, a sample chamber at least partly contained within an at least partially evacuated jacket, an outermost wall of the jacket being adjacent to or forming an outermost wall of the tool.

In such a tool the evacuated jacket acts to maintain the sample as originally retrieved, e.g. in single phase form (at original temperature).

Advantageously the sample chamber is substantially contained within the evacuated jacket.

Preferably, the evacuated jacket comprises first and second tubular bodies, the first tubular body comprising the outermost wall of the jacket and the second tubular body being provided within the first tubular body, an evacuated chamber being provided between the two bodies.

Advantageously, the evacuated chamber is formed by a longitudinal annular space between the bodies.

The pressure in the annular space may be approximately between $10^{-7}$ PSI and $10^{-11}$ PSI and typically around $10^{-8}$ PSI.

Preferably, the first and second bodies are formed in one piece, being joined at least one end.

Preferably also, the sample chamber is provided with a third tubular body which is at least partly provided within the second tubular body.

Advantageously, sample temperature maintenance means are provided, preferably between the second and third tubular bodies.

Preferably, the temperature maintenance means include a plurality of heaters spaced longitudinally between the second and third tubular bodies.

Advantageously the heaters are sized to seek to compensate for heat loss at their respective locations.

Advantageously first and second heaters provided at first and second ends of the third tubular body are more powerful than heaters provided distal from the first and second ends. This arrangement is particularly advantageous so as to seek to compensate for heat loss from the ends of the sample chamber. Preferably the second heater is more powerful than the first heater.

Preferably the temperature maintenance means further comprises at least one temperature sensor for detecting the temperature of the fluid sample.

Preferably the at least one temperature sensor measures the temperature of an outer wall of the third tubular body.

Preferably the tool further comprises means for controlling admission of a sample into the sample chamber.

The admission control means may comprise a floating piston controllably moveable longitudinally within the sample chamber.

The admission control means may further comprise means for controllably moving the floating piston.

The controllable movement means may comprise a further fluid and means for controllably reducing pressure of the further fluid.

Preferably the piston is mounted on and moveable along a piston rod.

The piston rod may have a piston stop at one end adapted to limit travel of the piston at that one end of the piston rod.

The piston rod may further carry a plug at another end. Advantageously ends of the sample chamber are defined by he piston stop and the plug.

The tool may be provided with one or more sample inlet ports.

The tool may also be provided with one or more sample utlet ports, which outlet ports may be distinct from the inlet ports.

The tool may also provide means for removing a sample from the sample chamber.

The sample removal means may include first and second ports which communicate with first and second outer ends of the sample chamber. Thus, in use, a pump may be connected across the first and second ports so as to apply a differential pressure across the first and second ends of the sample chamber, thereby effecting movement of the sample chamber within the tool towards one or more sample outlet ports.

In use, a sample transfer vessel may be connected to the one or more sample outlet ports via one or more valves so as to allow controllable transfer of the sample from the sample chamber to the transfer vessel.

Advantageously the transfer vessel may include a further floating piston provided within a transfer chamber.

Preferably the transfer chamber is of substantially the same volume as the sample chamber.

According to a second aspect of the present invention there is provided a well fluid sampling method comprising the steps of:

providing a well fluid sampling tool having a sample chamber at least partly contained within an evacuated jacket, an outermost wall of the jacket being adjacent to or forming an outermost wall of the tool;

lowering the tool down a wellbore to a location where well fluid is to be sampled;

admitting a sample into the sample chamber by means of controllable admission means;

sealing the sample chamber;

retrieving the sample to surface while substantially maintaining the temperature of the sample;

removing the sample from the sample chamber into a chamber of a sample transfer vessel.

By such a method it is sought to maintain the sample as originally sampled, e.g. in single phase form (and at substantially original temperature).

This may be achieved as the sample chamber has a predetermined volume; thus by seeking to maintain the temperature of the sample the pressure of the sample is also maintained.

Advantageously on admitting the sample into the sample chamber temperature and pressure outside the tool are measured and stored by suitable measurement means and storage means.

According to a third aspect of the present invention there is provided a well fluid sampling tool including a sample chamber and an at least partially evacuated jacket surrounding at least part of the sample chamber, the evacuated jacket comprising first and second tubular bodies having an at least partially evacuated annular space therebetween, the first and second bodies being integrally formed with one another.

Preferably the first and second bodies are integrally connected to one another at least at or near first adjacent ends of each body.

Preferably such integral connection may be formed by welding, and advantageously e-beam welding.

Preferably also, the first and second bodies are connected to one another at or near second adjacent ends of each body.

Advantageously a centraliser may be provided between the first and second bodies, which centraliser may preferably be made at least partly from titanium.

According to a fourth aspect of the present invention there is provided a method of operating a well fluid sampling tool, the tool comprising a sample chamber, heater means in thermal communication with the sample chamber and means for controlling the heater means including means for measuring temperature external of the tool, the method comprising:

storing a preset temperature on the control means;

lowering the tool down a borehole;

continually monitoring the temperature external the tool at predetermined intervals;

comparing the measured external temperature to the preset temperature and if the measured external temperature is greater than the preset temperature then causing the heater means to heat at least part of the sample chamber to the measured external temperature.

Advantageously, as the tool is lowered if the external temperature is greater than the preset temperature then the external temperature is stored as the preset temperature.

Advantageously as the tool is lowered the pressure external the tool is also continually monitored, and preferably the highest external pressure monitored is stored on the control means.

In a preferred embodiment the tool includes an electronic clock circuit and a memory logger circuit.

According to a fifth aspect of the present invention there is provided a well fluid sampling tool including a sample chamber and pressure relief means communicating between the sample chamber and external the tool such that, in use, if pressure in the chamber exceeds a predetermined level the pressure is relieved via the pressure relieve means.

The pressure relieve means may comprise a pressure relief valve or a breakable disc. The tool may include sample temperature maintenance means.

Provision of the pressure relief means seeks to avoid excessive pressure build-up within the sample chamber, e.g. due to thermal runaway of the temperature maintenance means.

A tool according to any of the first, third or fifth aspects hereinbefore mentioned may be inserted into a borehole by wireline and may be coupled together with similar tools or with other tools, for example, memory pressure gauges, togging tools, spinners or the like, by threaded cross-overs.

BRIEF DESCRIPTION OF THE DRAWINGS

An embodiment of the invention will now be described, by way of example only, with reference to the accompanying drawings, which are.

DETAILED DESCRIPTION OF THE PREFERRED EMBODIMENT

Figure 1A:
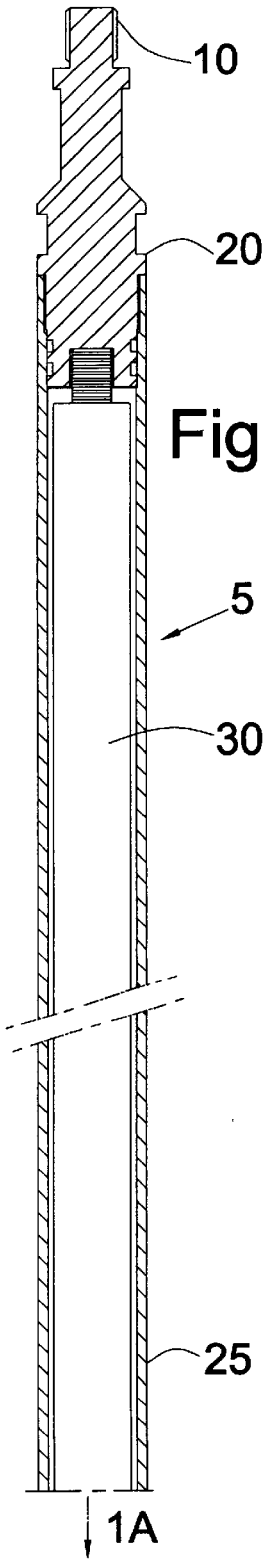
FIGS. 1(A)–(E) a series of cross-sectional side views of a well fluid sampling tool according to an embodiment of the present invention in a first position.
Figure 2A:
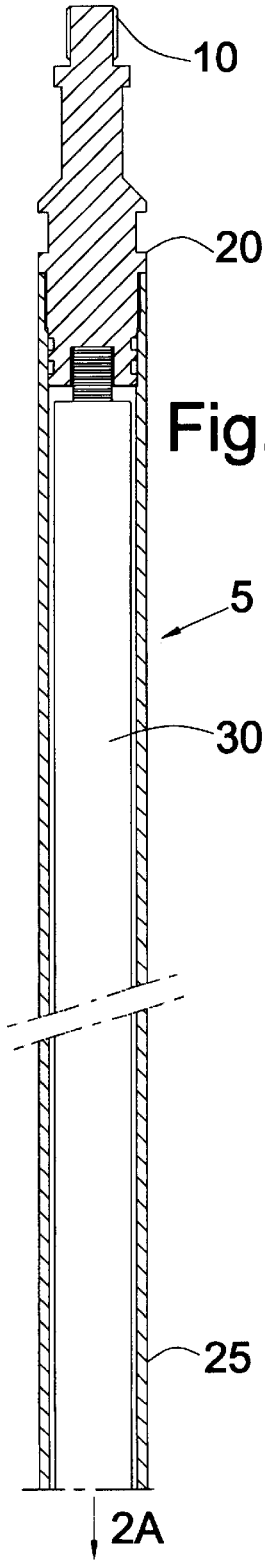
FIGS. 2(A)–(E) a series of cross-sectional side views of the well fluid sampling tool of FIGS. 1(A)–(E) in a second position.
Figure 1B:
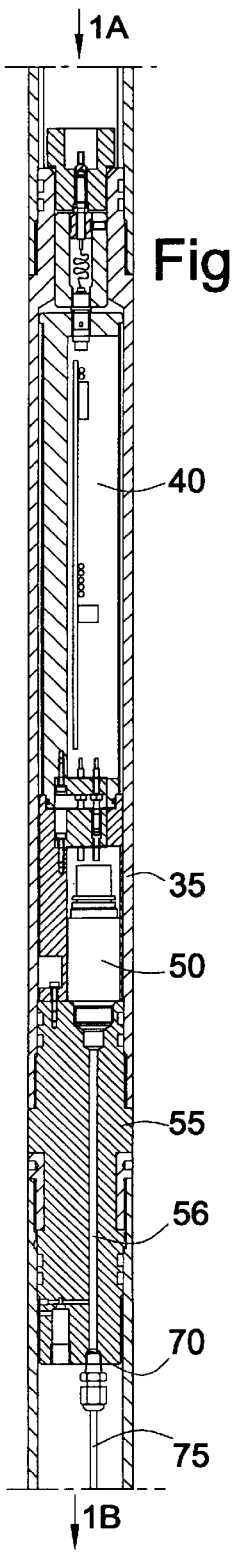
Figure 2B:
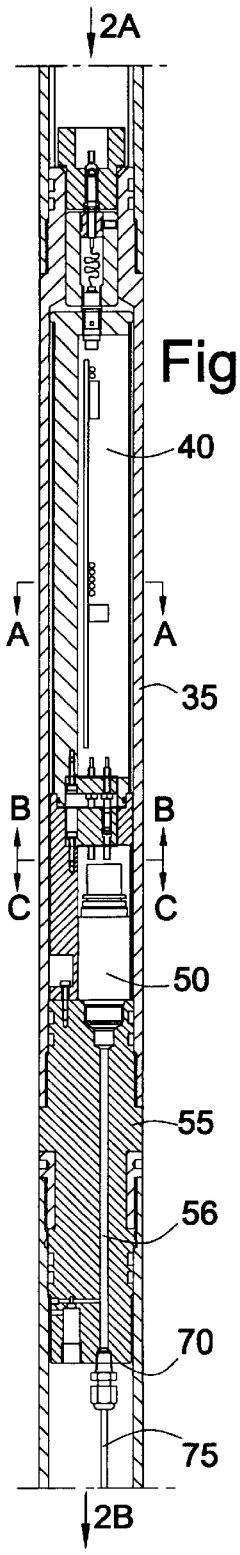
Figure 4:
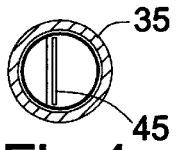
FIG. 4 a sectional view along line A—A of FIG. 2(B)
Figure 5:
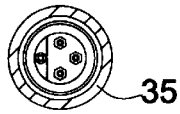
FIG. 5 a sectional view along line B—B of FIG. 2(B)
Figure 6:
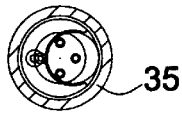
FIG. 6 a sectional view along line C—C of FIG. 2(B)
Figure 1C:
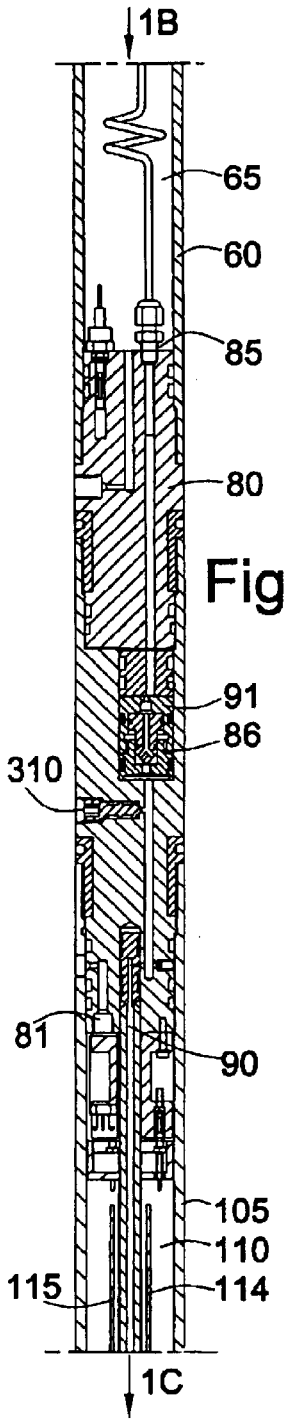
Figure 2C:
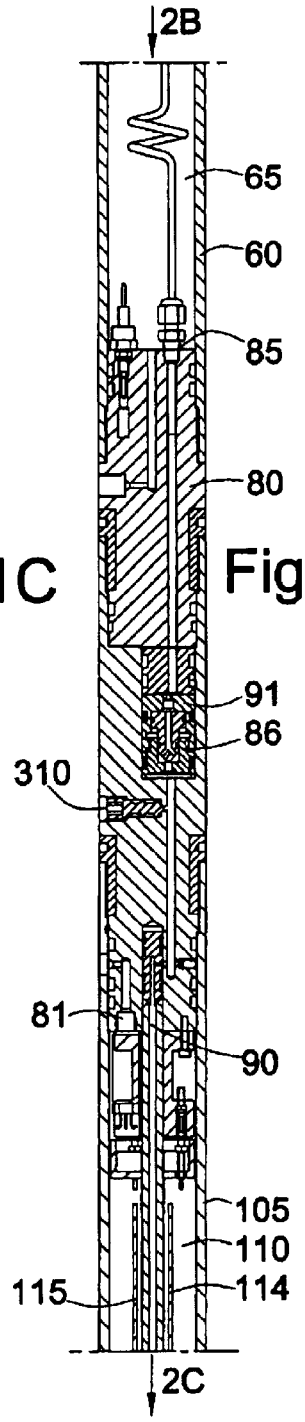

Referring initially to FIGS. 1(A)–(E) there is illustrated a well fluid sampling tool, generally designated 5, according to an embodiment of the present invention. The tool 5 has a first end 10, which end is normally the uppermost end when the tool 5 is conveyed down a borehole of a well, and a second end 15, which end is normally the lowermost end when the tool 5 is conveyed down the borehole.

The preferred maximum outer diameter of the tool 5 is approximately 2" so as to facilitate ease of transit of the tool 5 through an innerbore of a standard 2¼ test valve (not shown) up and down.

The tool 5 comprises a connector in the form of a top cross-over 20 by means of which the tool 5 can be connected to wireline, slickline, electric line or the like so as to be conveyed down or up a borehole of a well. Indeed the tool 5 may be coupled together with similar tools or with other downhole tools as is known in the art, e.g. by threaded cross-overs.

An end of the top cross-over 20 is threadably connected to and sealably engaged with a first end of a battery housing 25, which housing 25 provides a battery chamber holding a battery 30. In this embodiment the battery 30 is a lithium battery. The battery 30 powers all electrical/electronic components of the tool 5 hereinafter described.

A second end of the battery housing 25 is threadably connected to and sealably engaged with a first end of a clock board housing 35. The clock board housing 35 provides a clock board chamber 40, which chamber 40 holds a clock board 45 and a solenoid valve 50 which is controlled by the clock board 45.

A second end of the clock board housing 35 is threadably connected to and sealably engaged with a first end of a solenoid nipple 55.

A second end of the solenoid nipple 55 is threadably connected to and sealably engaged with a first end of a buffer chamber housing 60. The buffer chamber housing 60 provides a buffer chamber 65 which when the tool 5 is initially run downhole, prior to sampling, is filled with air. Further an input port 70 of the solenoid nipple 55 at the second end of the solenoid nipple 55 which communicates with the solenoid valve 50 via line 56 through the nipple 55 is connected to a first end of a tubing piece 75. The tubing piece 75 is filled with an hydraulic fluid, e.g. a mineral oil.

A second end of the buffer chamber housing 60 is threadably connected to and sealably engaged with a first end of a buffer chamber bleed-off nipple housing/prime port sub 80. The buffer chamber bleed-off nipple housing/prime port sub 80 provides a first output port 85 which is connected to a second end of the tubing piece 75, a first input port 90 at a second end of the buffer chamber bleed-off nipple housing 80 which communicates with the first output port 85 via a choke 86 including a pressure multiplier 91 which multiplier 91 divides (reduces) fluid pressure seen at the first input port 90 by, for example, X15 to provide a lower pressure at the first output port 85. Thus if fluid pressure at the first inlet port 90 is 15,000 PSI, fluid pressure at the first outlet port 85 would be 1,000 PSI. The choke 86 further provides a pressure activated valve/flow regulator 101.

In this way the pressure of fluid across the first inlet port 90 to the first outlet port 85 is divided by the multiplier 91, while the flow rate of fluid flowing from the first inlet port 90 to the first outlet port 85 is controlled. This control is important in controlling the timing of sample acquisition as will hereinafter become apparent. It is, for example, important not to sample too quickly thereby causing phase separation.

The housing/sub 80 also houses a pressure and temperature transducer 81 which measures the ambient downhole pressure and temperature before, at, and after the time of sampling and sends such information to a logger board 114 or alternatively the clock board 45 or a heater electronics board 115.

The second end of the housing/sub 80 is threadably connected to and sealably engaged with a first end of a heater board housing 105. The heater board housing 105 provides an air filled chamber 110 which contains the logger board 114 and a heater electronics board 115.

A second end of the heater board housing 105 is threadably connected to and sealably engaged with a first end of a connector piece 120. The first end of the connector piece 120 provides a first output port 125 which is connected to the first input port 90 of the housing/sub 80 via a first pipe piece 130.

A second end of the connector piece 120 is provided with a first inlet port 140 which communicates with the first outlet port 125.

A second end of the connector piece 120 is rigidly connected to a first end of a first tubular body 160. The first tubular body 160 comprises an outermost wall of the tool 5. The first tubular body 160 is integrally formed at or near a second end thereof with a second tubular body 165 such that the first and second tubular bodies 160, 165 are substantially concentric and an annular space 170 is formed between the two bodies 160, 165. The annular space 170 is at least partially evacuated, e.g. to a pressure of around between $10^{-7}$ PSI and $10^{-11}$ PSI, and typically around $10^{-8}$ PSI.

The annular space 170 is sealed at or near the first end of the first tubular body 160 by a portion 161 of connector piece 120, which portion 161 may be welded to the first tubular body 160, e.g. by e-beam welding. Further a centraliser 175 is provided between the first and second tubular bodies 160,165.

The first and second tubular bodies 160, 165 and the evacuated annular space 170, therefore, form an evacuated jacket, wherein an outermost wall of the jacket comprises an outermost wall of the tool 5.

Contained substantially concentrically within the second tubular body 165 is a third tubular body 180. The third tubular body 180 is sealed at a first end by an end plug 185 which has a through flow orifice 190 allowing communication between an hydraulic chamber 195 of the third tubular body 180 and the first input port 140. The hydraulic chamber 195 is initially filled with hydraulic fluid, e.g. mineral oil.

Figure 1D:
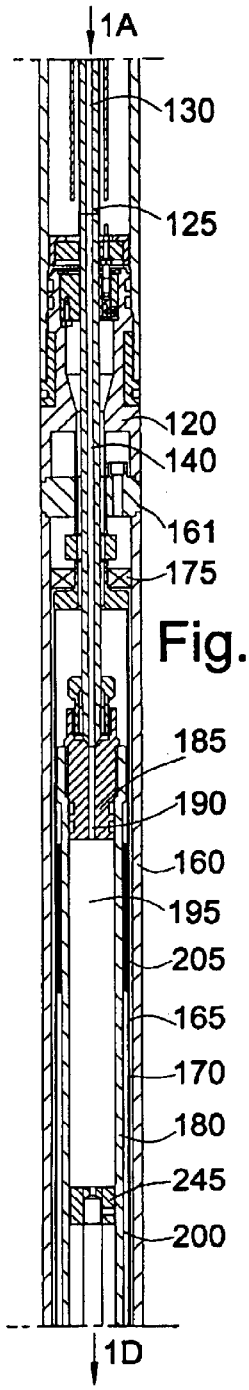
Figure 2D:
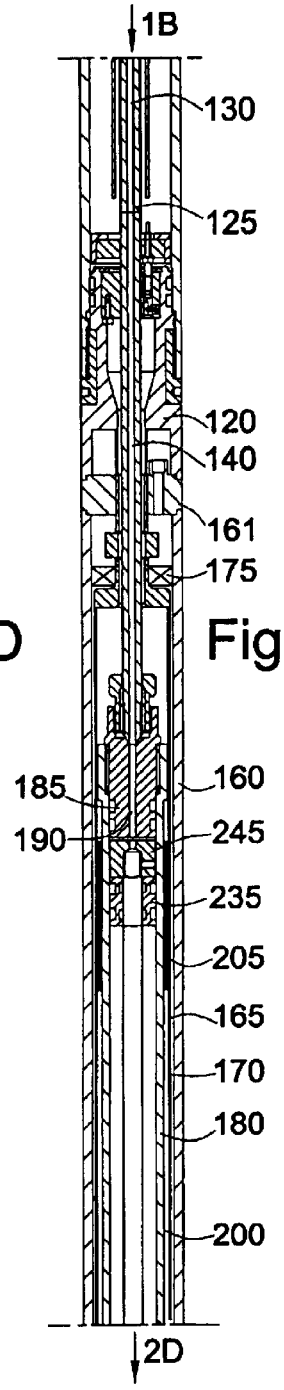
Figure 3D:
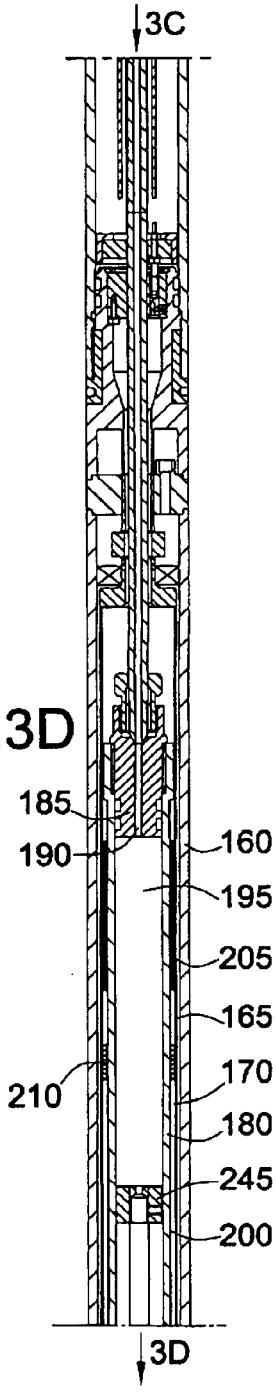
Figure 1E:
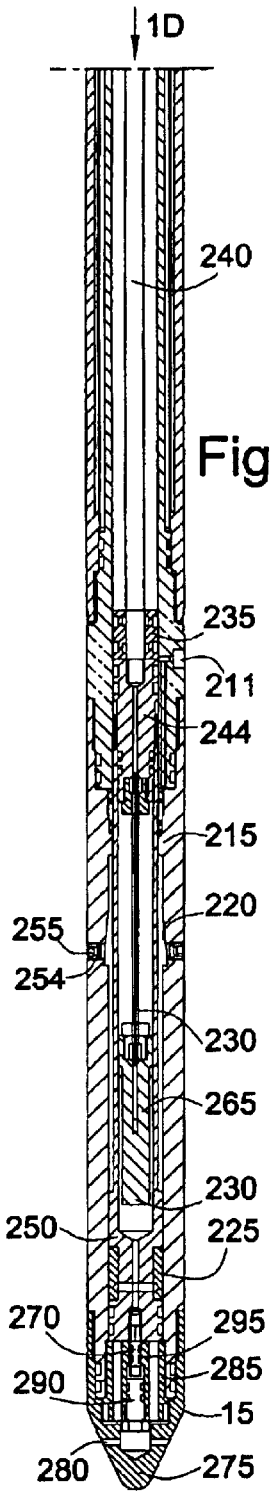
Figure 2E:
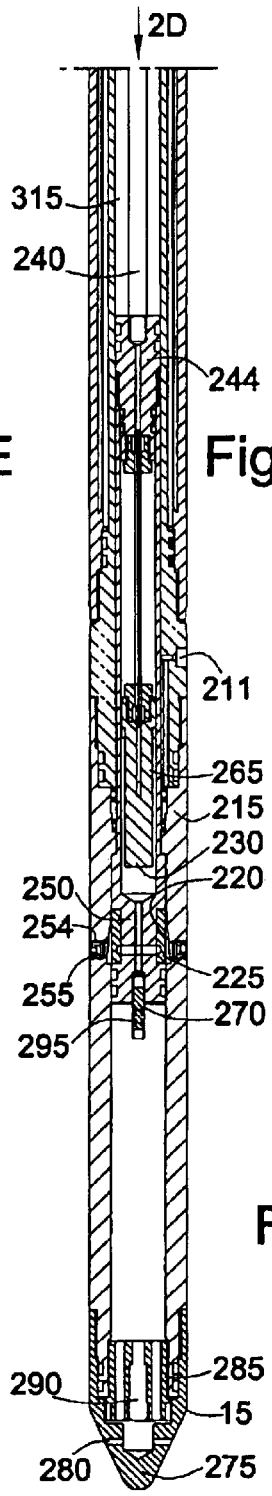
Figure 3E:
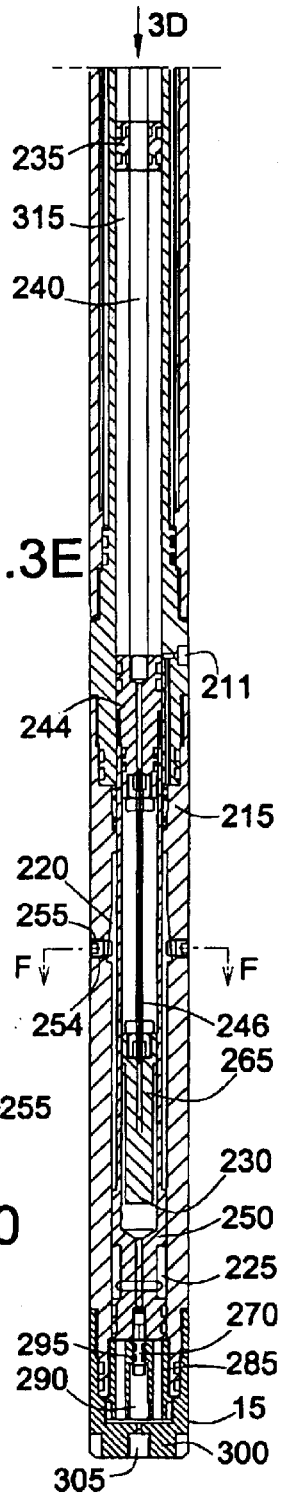
Figure 10:
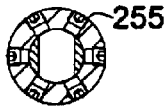
FIG. 10 a sectional view along line F—F of FIG. 3(E)
Figure 7:
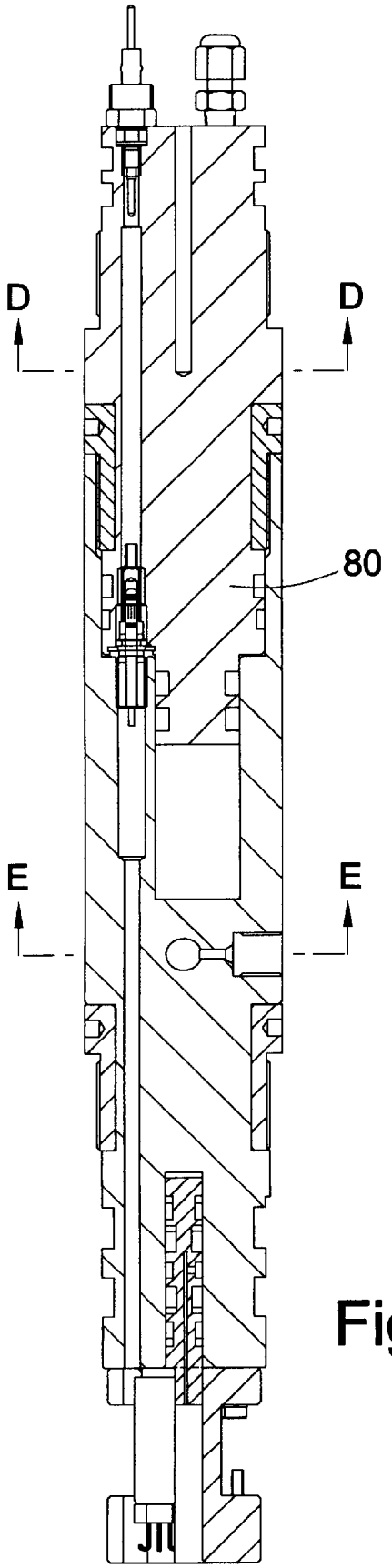
FIG. 7 a cross-sectional side view of a choke holder forming part of the tool of FIGS. 1(A)–(E).
Figure 8:
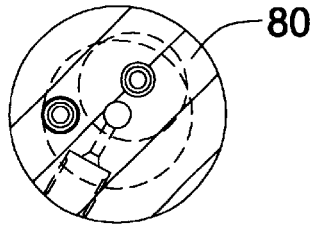
FIG. 8 a sectional view along line D—D of FIG. 7.
Figure 9:
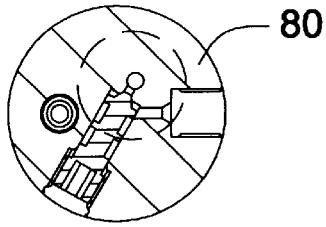
FIG. 9 a sectional view along line E—E of FIG. 7.
Figures 11A, 11B:
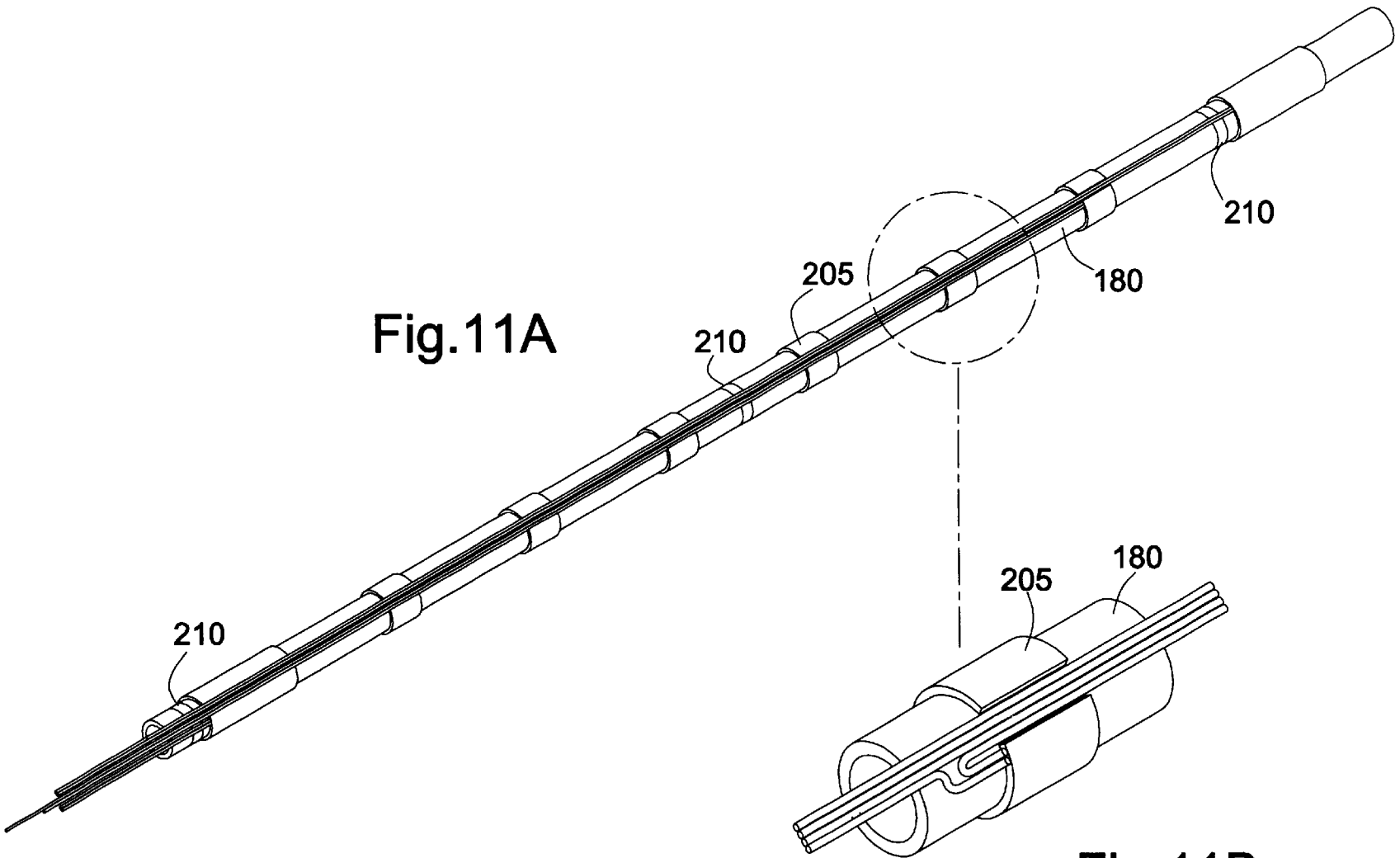
FIG. 11(A) a schematic perspective view from one side to one end and above of a plurality of heaters provided on a sample chamber comprising part of the tool of FIGS. 1(A)–(E)
FIG. 11(B) a schematic perspective view from one side to one end and also to an enlarged scale of one of the heaters of FIG. 11(A) provided on the sample chamber comprising part of the tool of FIGS. 1(A)–(E)

As can be seen from FIGS. 1(D) and 1(E) a further annular space 200 is provided between the second and third tubular bodies 165, 180. A plurality of heaters 205 are provided in the annular space 200. Referring to FIGS. 11(A) and (B) there is illustrated in more detail the heaters 205 provided upon an outer surface of the third tubular body 180. As can be seen, in this embodiment eight heaters are provided along the length of the third tubular body 180. The heaters 205 provided at each end of the third tubular body 180 are more powerful—i.e. capable of dissipating a larger amount of heat—than the other heaters. This is because heat loss can be expected to be greater from the ends of the third tubular body 180, in use.

As can further be seen from FIG. 11 a plurality of pressure/temperature transducers (PRT's) 210 are provided on the outer surface of the third tubular body 180. In use, the PRT's 210 detect the pressure and/or temperature of a sample contained within the third tubular body 180. The measured pressure/temperature is compared to the originally sampled pressure/temperature stored by the heater electronics board 105, and if the measured pressure/temperature is below the originally sampled pressure/temperature the board 105 switches on the heaters 205 until the originally sampled pressure/temperature is regained.

A second end of the first tubular body 160 is threadably connected to and sealably engaged with a portion of the third tubular body 180 adjacent a second end thereof. The second end of the third tubular body provides a plurality of sample ports 211 through a side wall thereof. In this embodiment there are four such sample ports 211. In use, two sample ports 211 are used for retrieving a sample into the tool 5, while the other two sample ports 211 are used for retrieving the sample out of the tool 5. Thus when retrieving the sample into the tool 5 the first two sample ports 211 are open and the second two sample ports 211 are plugged by appropriate means, while when retrieving the sample out of the tool 5 the first two sample ports 211 are appropriately plugged, while the second two sample ports are unplugged. This arrangement seeks to ensure that foreign matter such as dirt is not entrained into the sample.

The second end of the third tubular body 180 is threadably connected to and sealably engaged with a dog housing 215. The dog housing 215 includes a tapered recess 220 for reception of spring-loaded dogs 225 carried by a sampling assembly 230 moveable longitudinally within the third tubular body 180 and dog housing 215.

The sampling assembly 230 comprises a floating piston 235, a first surface of which is exposed to the pressurised hydraulic fluid. The piston 235 is mounted for longitudinal movement upon a piston rod 240. The piston rod 240 provides a piston stop 245 at a first end thereof. Further the sampling assembly provides at a second end of the piston rod 240 an end valve plug 244 which carries an end valve body 250. The end valve body 250 carries the spring-loaded dogs 225. It is noted that the floating piston 235, the end valve plug 245 and the end valve body 250 all carry on their outer surfaces one or more seals so as to provide sealing engagement with an internal surface of the third tubular body 180 and/or an internal surface of the dog housing 215 as the sampling assembly 230 is held within and moves within the third tubular body 180 and the dog housing 215.

The recess 220 communicates with an outer surface of the dog housing 215 via through-apertures 254 each containing a grub screw 255 and filter screen 260. In use, a tool (not shown) can be applied to the dogs 225 via the apertures 254 to effect collapse of the dogs 225, as will be described hereinafter.

The valve end body 250 further provides a pressure relief means 265 (which may preferably be in the form of a burst disc or alternatively a pressure relief valve) and nipple 270 protruding from an end thereof. The pressure relief means 265 may be designed so as to relieve pressure of a sample within the tool 5 if the pressure exceeds a predetermined value.

For retrieval of a sample into the tool 5, a second end of the dog housing 215 is threadably connected to and sealably engaged with a first end of a nose cone 275 or cross-over to another tool. The nose cone 275 includes a plurality of inlet ports 280 (in this embodiment four) at a second end thereof.

Protruding from the second end of the dog housing 215 and carried thereby is a front inlet plug 285 having a through flow orifice 290 capable of receiving the nipple 270. The nipple 270 carries one or more seals 295 such that the nipple 270 may be sealably engaged in the orifice 290.

Figure 3A:
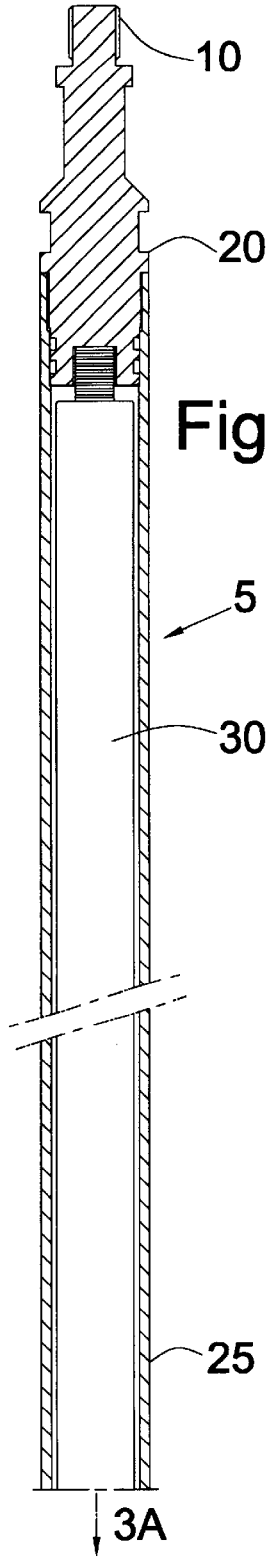
FIGS. 3(A)–(E) a series of cross-sectional side views of the well fluid sampling tool of FIGS. 1(A)–(E) in a third position.
Figure 3B:
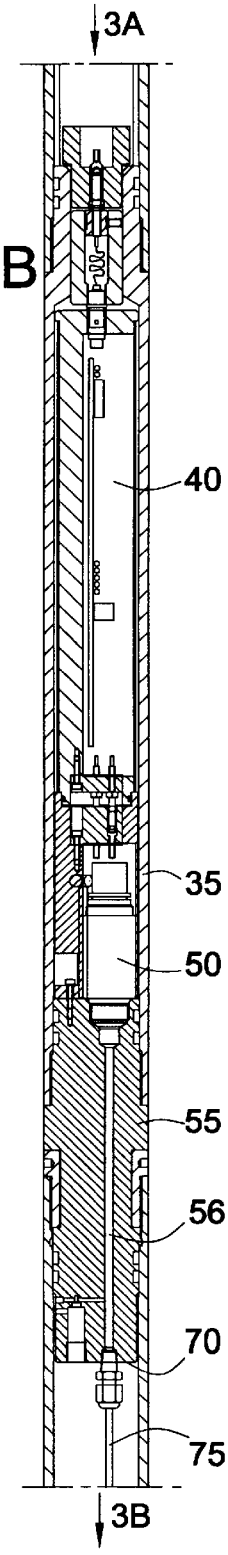
Figure 3C:
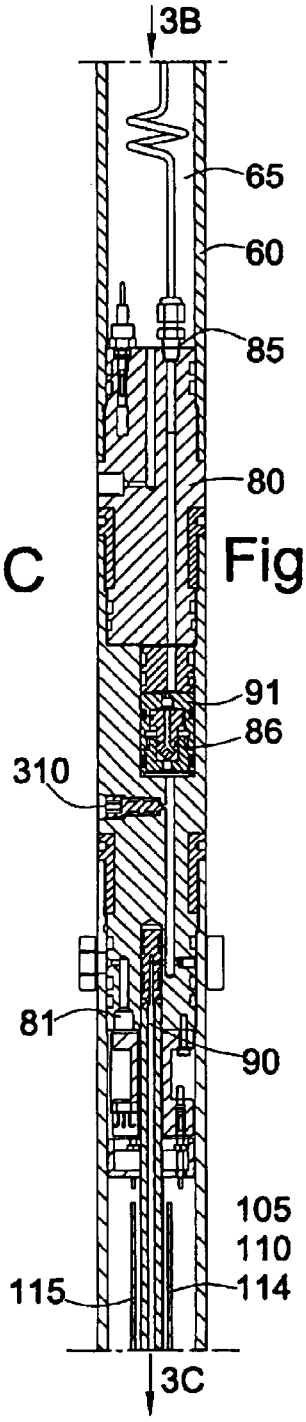

For retrieval of a sample from the tool 5 the nose cone 275 is replaced by a transfer head 300. The dog housing 215 is threadably connected to and sealably engaged with a first end of the transfer head 300. A second end of the transfer head 300 provides a pump connection port 305. As can be seen from FIG. 3C the housing/sub 80 provides a further pump connection port 310. As will be described hereinafter, in use, a pump (not shown) may be connected across the pump connection ports 305, 310 to effect removal of a sample. Alternatively the housing/sub 80 may be removed while maintaining pressure of the sample.

As will be appreciated from the foregoing, in use, a sample chamber 315 is formed by a second face of the floating piston 235, inner wall of the third tubular body 180, and an end of the end valve plug 245. In this embodiment the volume of the sample chamber 315 is approximately 300 cc. However, it is envisaged that in alternative embodiments the chamber 315 volume may be in the range 300 cc–600 cc and preferably 350 cc–500 cc.

Regarding material selection, the first and second tubular bodies 160, 165 may each be made from stainless steel. In this embodiment the first tubular body 160 is designed to withstand a pressure of approximately 20,000 PSI from outwith. Further the third tubular body 180 may be made from stainless incanel, and designed to withstand a pressure of approximately 15,000 to 20,000 PSI from within.

Figure 12:
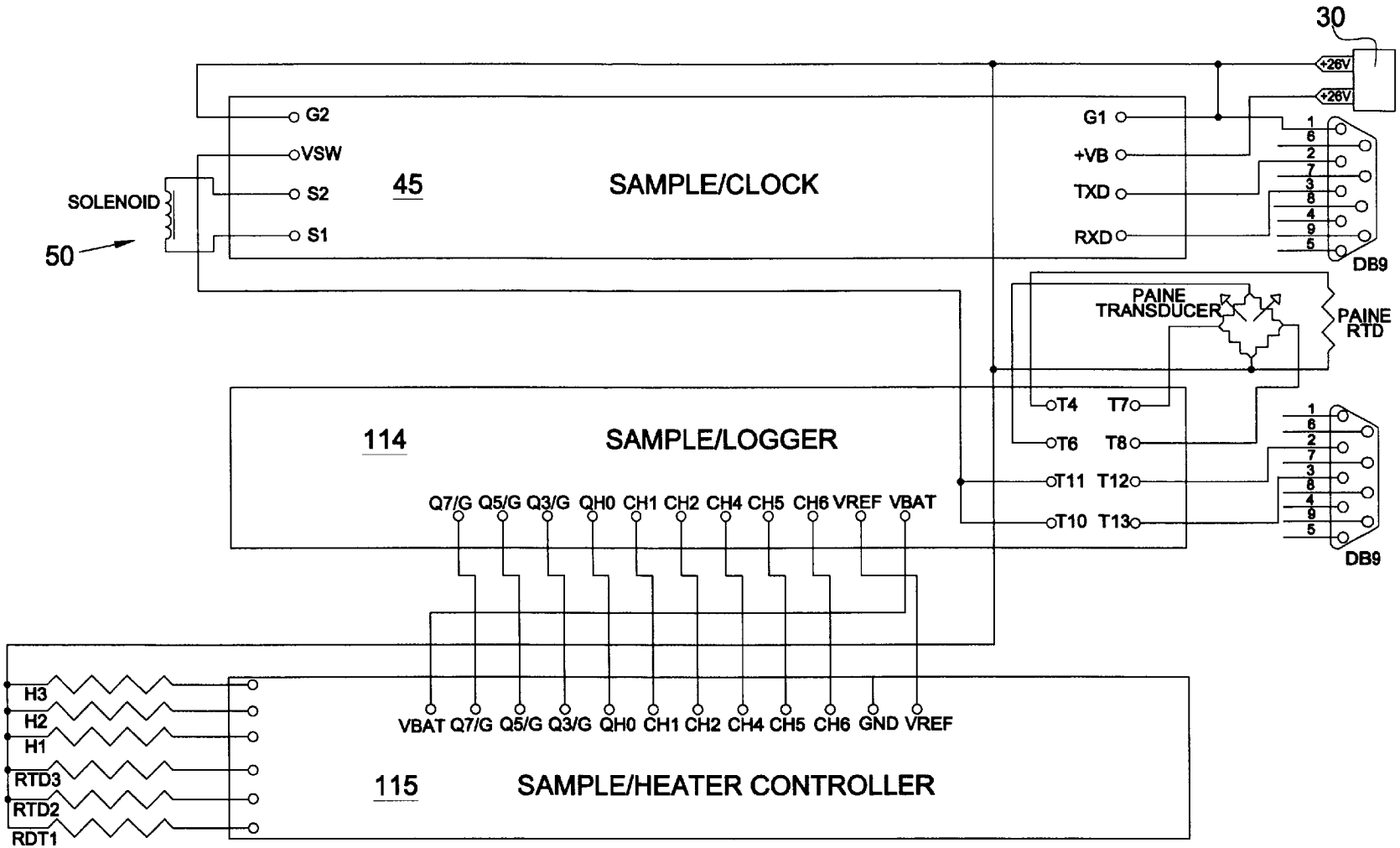
FIG. 12 a schematic diagram of electronic circuitry associated with the tool of FIGS. 1(A)–(E)

Referring now to FIG. 12 there is shown a schematic diagram of electronic circuitry associated with the tool 5. The electronic circuitry comprises the battery 30 which powers the clock board 45, logger board 114 and heater electronics board 115. As can be seen from FIG. 12 the clock board 45 is connected to and controls solenoid valve 50. Further the clock board 45 is connected to the logger board 114 such that at a predetermined (programmable) time a clock on the clock board 45 activates the solenoid valve 50, causing the pressure and temperature transducer 81 to instantaneously measure the downhole pressure and temperature and log these measurements to the clock board 45. The clock board 45 is further connected to the heater electronics board 115 such that the measured value of temperature and pressure at time of sampling stored in a memory on the clock board 45 can be compared to the measured values of temperature measured by the temperature transducers 210 while the tool 5 is retrieved to surface, and indeed thereafter until the sample is removed from the tool 5, in order that the heater electronics board 115 can thereby seek to maintain the original sampled conditions within the sample chamber 315 by means of the heaters 205.

Referring now to FIGS. 13(A) through 15, which show circuit diagrams for various parts of the electronic circuitry of FIG. 12. It will be appreciated that each of these FIGS. 13(A)–15, includes traditional circuit diagram numbering and symbols in addition to the specific reference numerals referenced in this specification. Such symbols and numbering are known in the art. However, in general, the symbols and numbering may be identified as follows: the reference symbols R# (where # is a number) refer to resistors; the reference symbols C# (where # is a number) refer to capacitors, the reference symbols U3* (where * is a letter) refer to inverters; the reference symbols U4* (where * is a letter) refer to NAND gates, the reference symbols Q# (where # is a number) refer to transistors, and the reference symbols D# (where # is a number) refer to diodes.

Figure 13A:
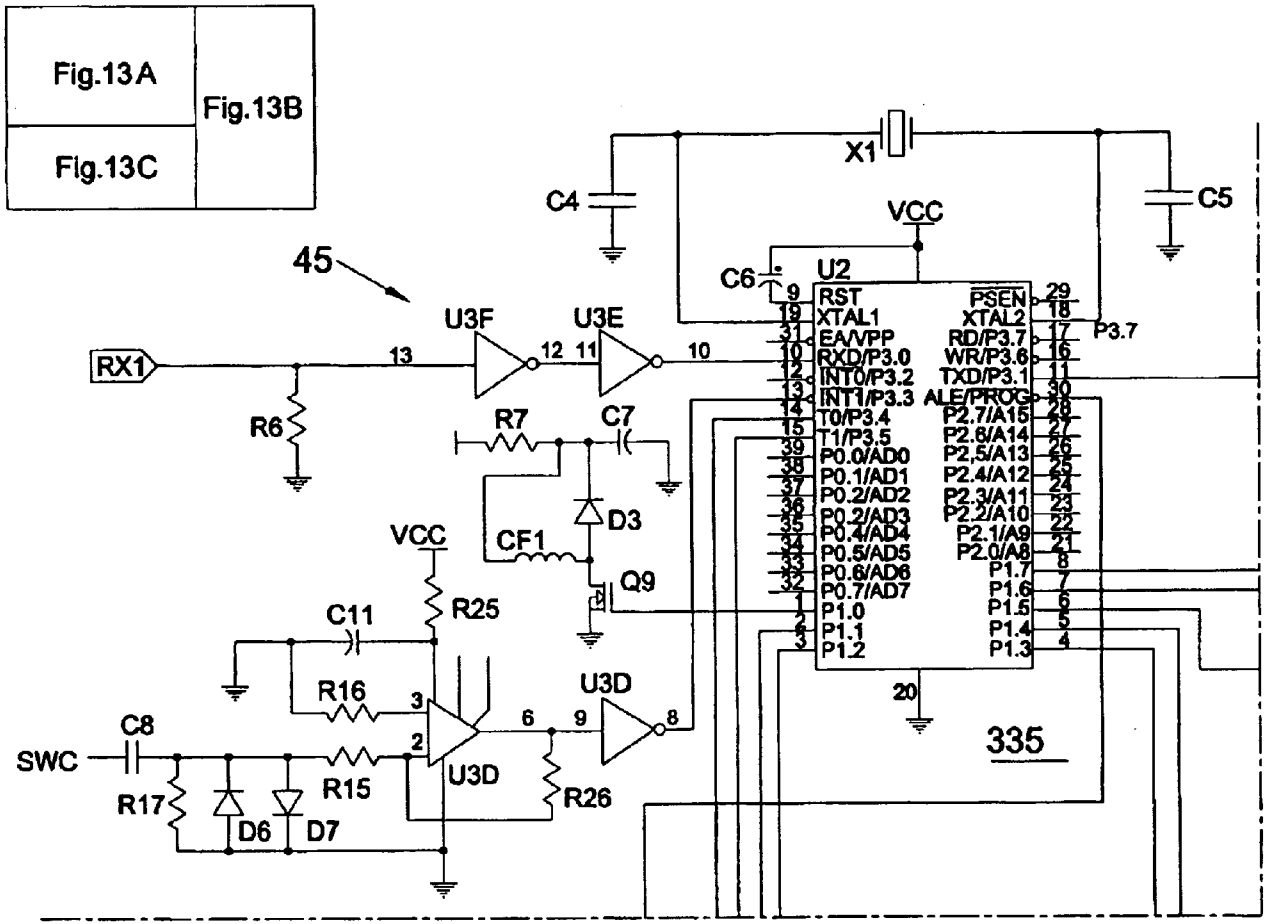
FIGS. 13(A)–(C) a series of detailed circuit diagram of a clock board comprising part of the electronic circuitry of FIG. 12.
Figure 13B:
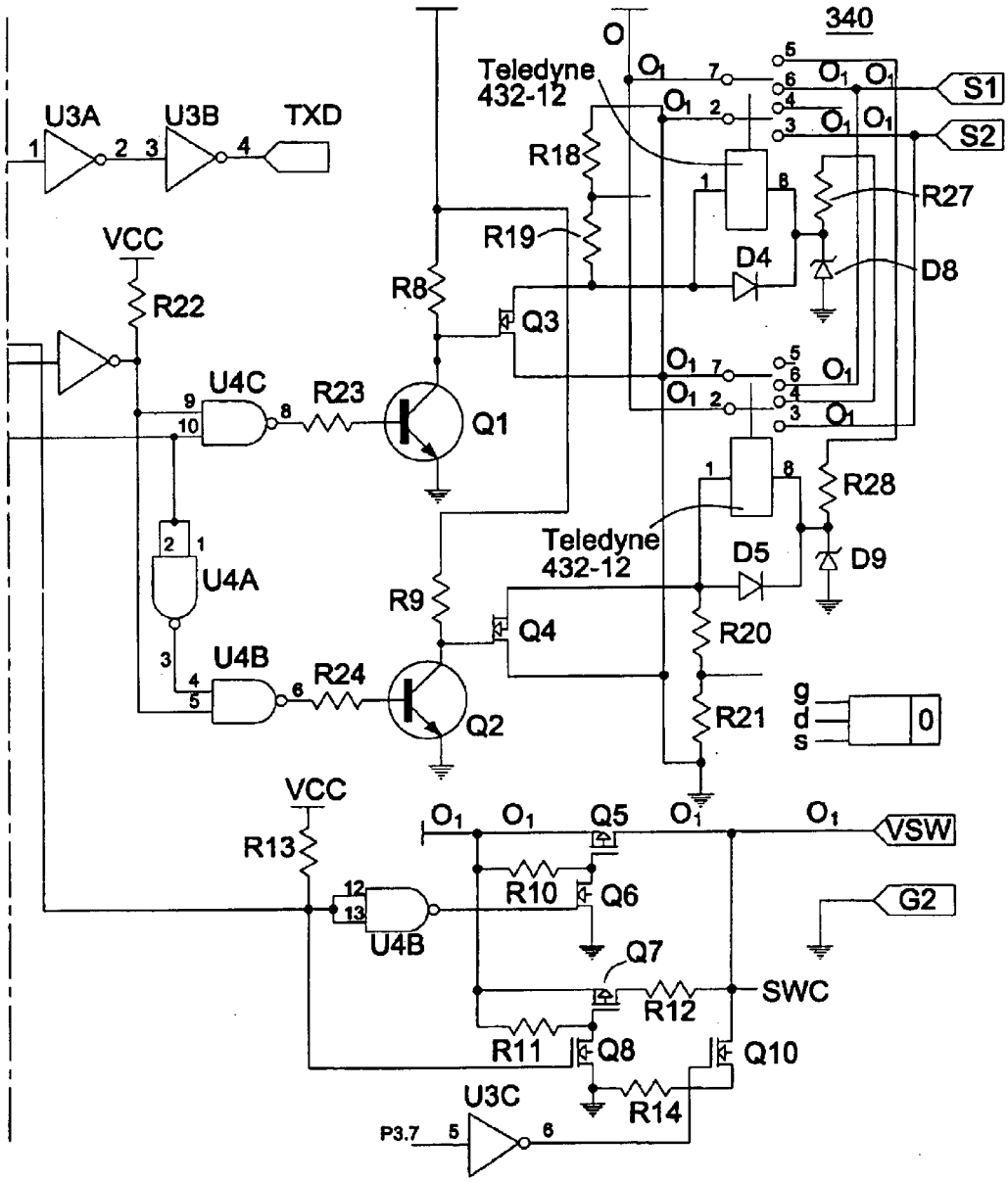
Figure 13C:
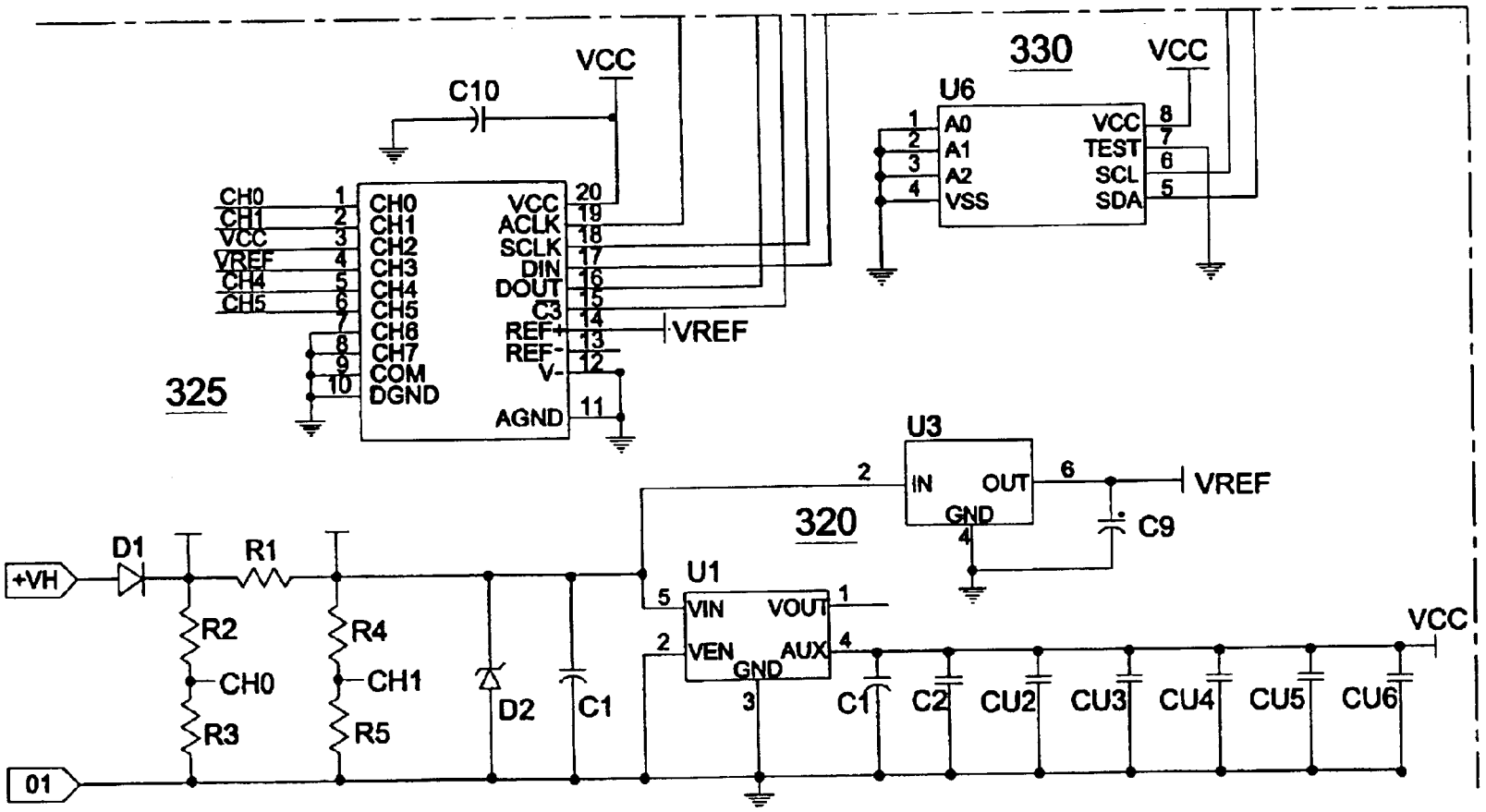

Referring to FIGS. 13(A)–(C), the clock board 45 comprises a regulator 320 for powering the clock board 45, an analog-to-digital convertor 325, a memory 330, a microprocessor 335 and a solenoid control circuit 340. The clock board 45 includes a communications line Rx1 which allows communication to and from a computer before and after sampling, solenoid control lines S1 and S2 and communications line SWC to logger board 114.

Figure 14A:
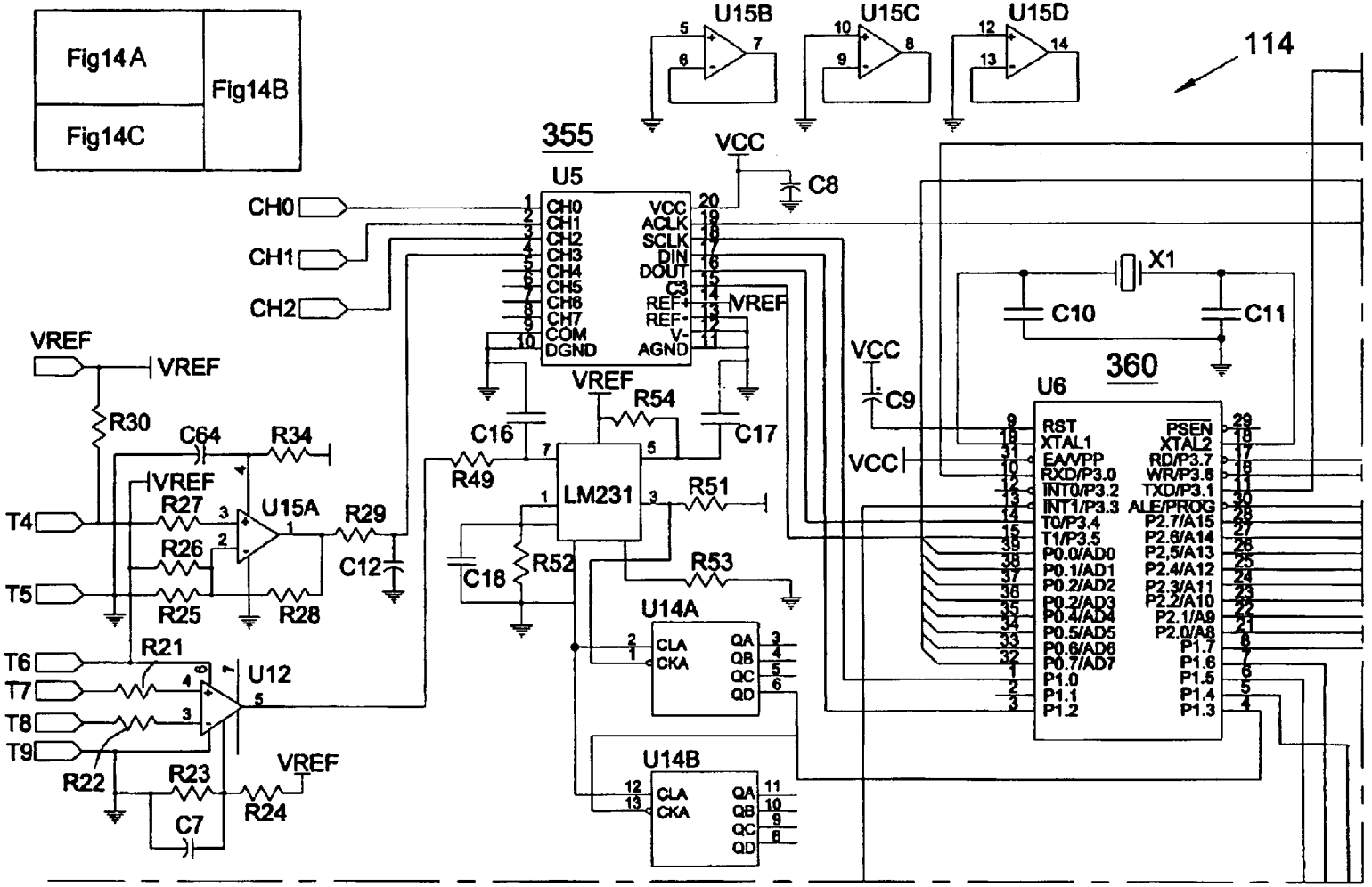
FIGS. 14(A)–(C) a series of detailed circuit diagram of a logger board comprising part of the electronic circuitry of FIG. 12.
Figure 14B:
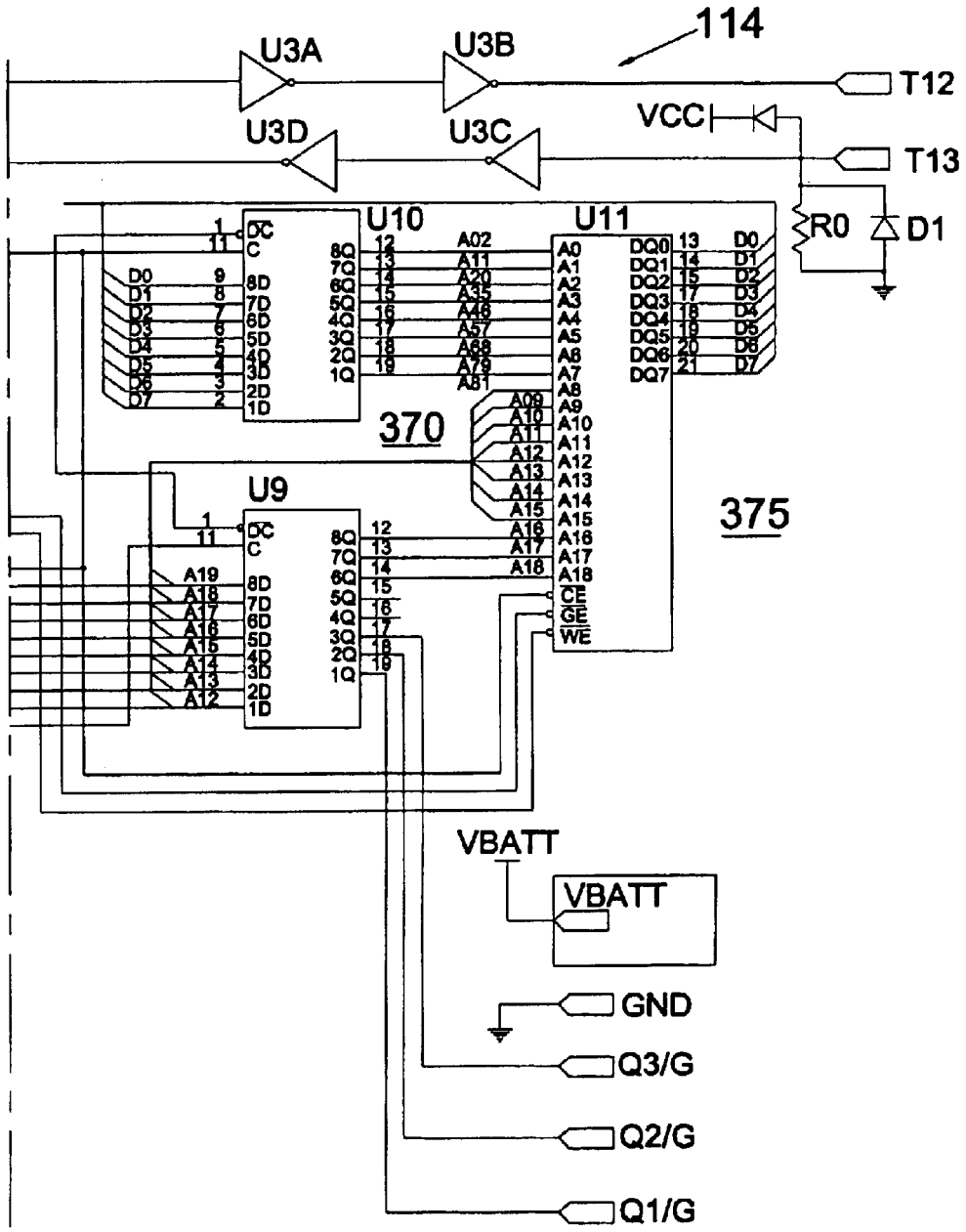
Figure 14C:
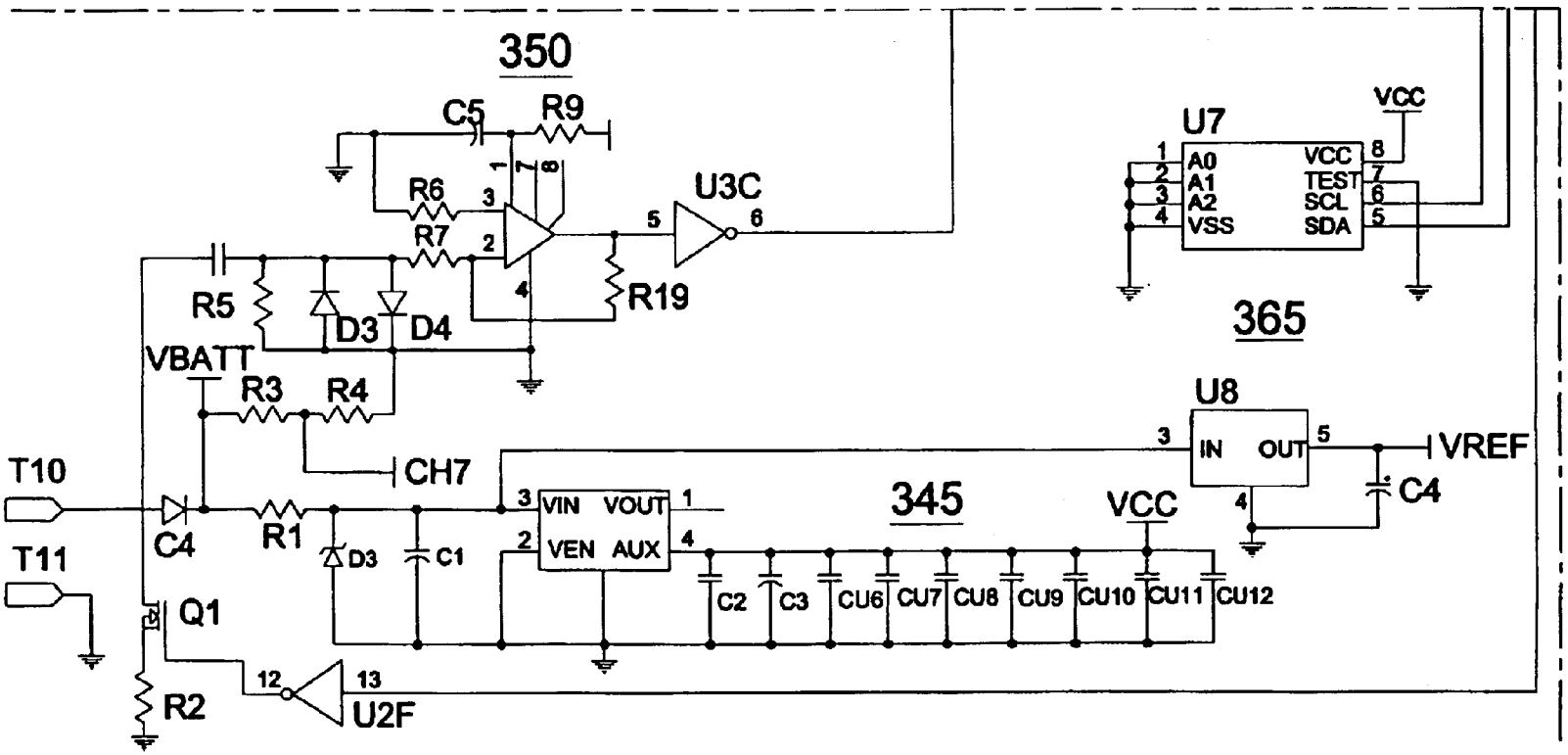

Referring to FIGS. 14(A)–(C), the logger board 114 comprises a regulator 345, a communications receive/decode circuit 350, an analog-to-digital convertor 355, a microprocessor 360, a sampling pressure/temperature memory 365, addressing latches 370, and a flash memory for data storage 375. The logger board 114 also provides temperature input lines T4, T5 and pressure input lines T6, T7, T8, and T9 from the temperature/pressure transducer 81, as well as communication output line T12 which may be connected to a computer after retrieval of the tool 5 from downhole.

Figure 15:
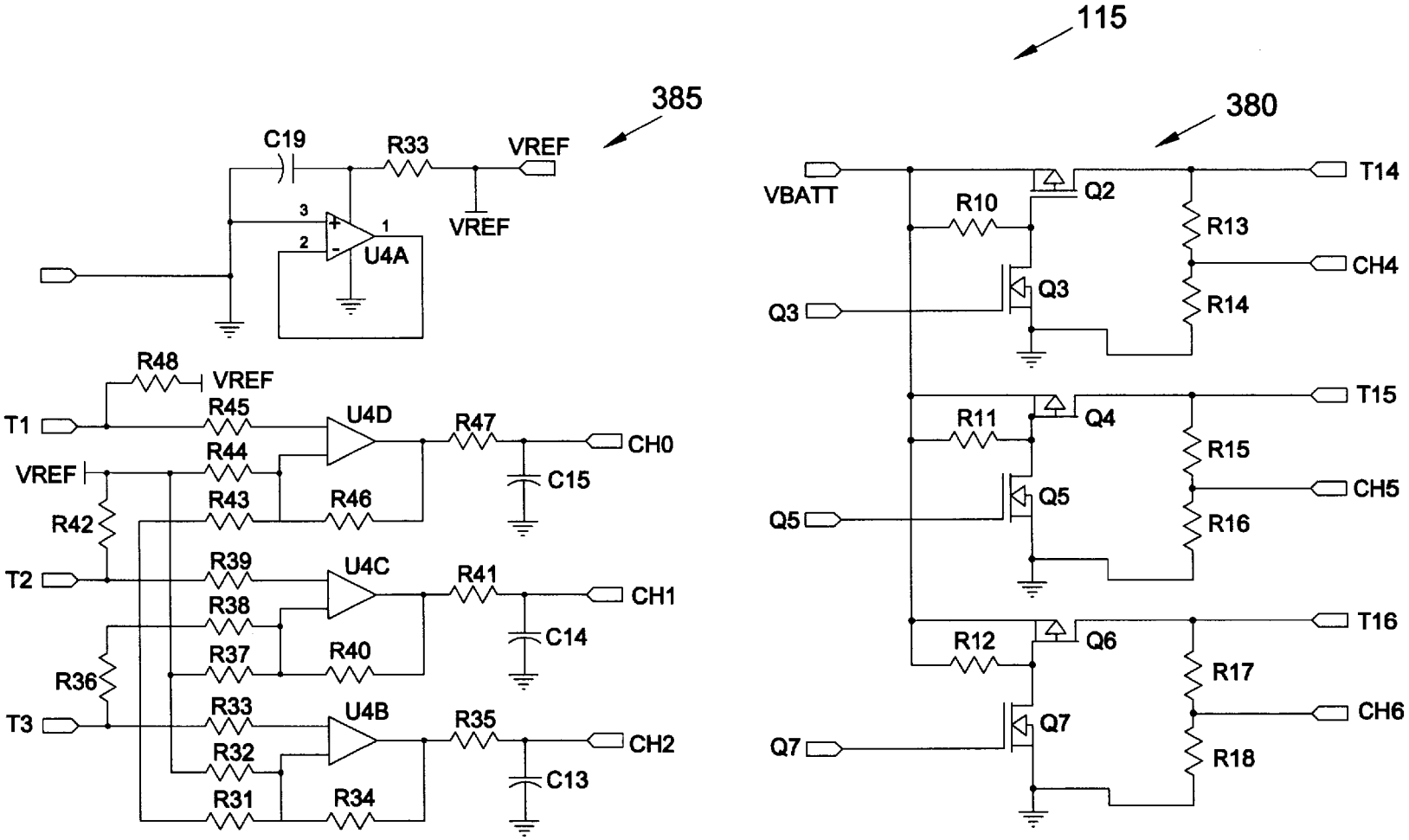
FIG. 15 a detailed circuit diagram of a heater electronics board comprising part of the electronic circuitry of FIG. 12.

Referring now to FIG. 15 there is show circuitry of the heater electronics board 115 which comprises a heater control circuit 380 having an output T14, CH4, T15, CH5, T16, CH6 to each of the heaters 205, an input VBATT from the battery 30 and inputs Q3, Q5, and Q7 from the latches 370 of the logger board 114.

The heater electronics board 115 also provides input circuit 385 comprising inputs T1, T2, and T3 from the temperature transducers 210 and outputs CH0, CH1, and CH2 to the analog-to-digital converter 355 of the logger board 114.

In use, prior to the tool 5 being lowered down a borehole the clock on the clock board 45 is set to activate the solenoid valve 50 after a predetermined time.

The tool 5 is then lowered down within a borehole, e.g. by wireline, in a first position as illustrated in FIGS. 1(A)–(E). In this first position pressurised hydraulic fluid, e.g. mineral oil, is contained within the hydraulic chamber 195. The pressurised fluid holds the floating piston 235 at the second end of the piston rod 240 against the end valve plug 245. In this position a first two of the sample ports 211 are appropriately plugged, while a second two of the sample ports 211 are left opened. However, well fluid cannot enter into the tool 5 via those ports 211 as the force of the pressurised hydraulic fluid acting on the piston 235 exceeds the force of the well fluid seeking to enter the tool 5.

It should be noted that the heaters 205 may be used to heat the hydraulic fluid within the third tubular body 80. Such heating may occur on surface, while the tool 5 is lowered down the borehole, and/or when the tool 5 is lowered to a required position. In this way the third tubular body 180 may be pre-heated to close to an expected sample temperature, thereby seeking to avoid cooling of a sample when it enters the sample chamber 315.

After the predetermined time the clock activates the solenoid valve 50. This causes a flow path to open between the tubing piece 75 and buffer chamber 65 thereby allowing mineral oil to bleed into the buffer chamber 65. This causes hydraulic fluid, i.e. mineral oil, to exit the hydraulic chamber 195 and bleed into the buffer chamber 65 via first pipe piece 130, choke 86 and tubing piece 75. Thus the pressure of the hydraulic fluid is eventually caused to fall below the ambient downhole pressure. At this point the piston 235 begins to move towards the piston stop 245 thereby admitting sample into the sample chamber 315.

As sample enters the sample chamber 315 the piston 235 moves towards and ultimately strikes the piston stop 245. It is noted that a first end of the nipple 270 is attached to an end of the end valve plug 244. Thus the effective area of the first (top) end of the end valve plug 244 is greater than the effective area of the second (bottom) end of the end valve plug 244. That is to say the effective well fluid pressure seen at the first end is less than that seen at the second end. Thus, a pressure imbalance exists causing the sampling assembly 230 to move towards the first end of the third tubular body 180. Such movement causes the sample chamber 315 to be sealed from the ports 211. Continued movement causes the dogs 225 to engage in recess 220. In this way a well fluid sample is retrieved into the sample chamber 315. The tool 5 is then in the position shown in FIGS. 2(A)–(E).

The tool 5 may then be retrieved to the surface, and the sample retrieved out of the tool 5 as hereinafter described. However, before the sample is retrieved out of the tool the temperature and pressure of the sample within the fixed volume sample chamber 315 is monitored by temperature transducers 210, compared to the original values detected by transducer 310 stored on the clock board 45, and if the temperature of the sample falls below the originally sampled values the logger board 114 circuitry causes the heater controller circuit 380 to controllably turn on the heaters 205 until the original values are regained. In this way the. tool 5 seeks to maintain the sample in its original state. The evacuated jacket forming an outer wall of the tool 5 assists in maintaining the sample in its original state by seeking to reduce heat loss therefrom.

Referring finally to FIGS. 3(A)–(E) once the tool 5 is retrieved the sample may be retrieved from the tool 5 by the following procedure, either on-shore e.g. in a laboratory, or alternatively off-shore, if facilities permit. Firstly, the nose cone 275 is replaced by a transfer head 300. Secondly, the first two sample ports 211 are plugged, and the second two sample ports 211 unplugged and connected to a transfer vessel via an on-off valve. Thirdly, the clock board 45 is interrogated to deduce the as-sampled temperature and pressure values. Fourthly, a pump (not shown) is connected across the pump connection ports 305, 310 and the pressure thereacross equalised with the pressure of the sample. Fifthly, a tool (not shown) may be applied to collapse the dogs 225. The sample 315 is then free to move within the tool 5.

Next a pressure imbalance is provided between the pump connection ports 305, 310 thereby causing the sample and the sampling assembly 230 to move towards the second two sample ports 211. Samples can then communicate with these ports 211. Finally, the on-off valve is opened and sample transferred into the transfer vessel by manipulation of the pressure imbalance while carefully maintaining the volume of the sample at all times, and also seeking to maintain the temperature and pressure of the sample as originally taken from the well.

It will be appreciated that the embodiment of the invention hereinbefore described is given by way of example only, and is not meant to limit the scope of the invention in any way.

What is claimed is:

1. A well fluid sampling tool comprising a sample chamber at least partly surrounded by an at least partially evacuated jacket and a separate annular space, the sample chamber and separate annular space being separated by a tubular member, wherein the annular space is at least partly surrounded by the at least partially evacuated jacket, an outermost wall of the jacket being adjacent to or forming an outermost wall of the tool.

2. A well fluid sampling tool as claimed in claim 1, wherein the sample chamber is substantially surrounded by the evacuated jacket.

3. A well fluid sampling tool as claimed in claim 1, further comprising sample temperature maintenance means.

4. A well fluid sampling tool as claimed in claim 3, wherein the temperature maintenance means further comprises at least one temperature sensor for detecting the temperature of the fluid sample.

5. A well fluid sampling tool as claimed in claim 1, wherein the tool further comprises means for controlling admission of a sample into the sample chamber.

6. A well fluid sampling tool as claimed in claim 5, wherein the admission control means comprises a floating piston controllably moveable longitudinally within the sample chamber.

7. A well fluid sampling tool as claimed in claim 6, wherein the admission control means furthers comprise means for controllably moving the floating piston.

8. A well fluid sampling tool as claimed in claim 7, wherein the controllable movement means comprises a fluid and means for controllably reducing pressure of said fluid.

9. A well fluid sampling tool as claimed in claim 6, wherein the piston is mounted on and moveable along a piston rod.

10. A well fluid sampling tool as claimed in claim 9, wherein the piston rod has a piston stop at one end adapted to limit travel of the piston at that one end of the piston rod.

11. A well fluid sampling tool as claimed in claim 10, wherein the piston rod further carries a plug at another end.

12. A well fluid sampling tool as claimed in claim 11, wherein ends of the sample chamber are defined by the piston stop and the plug.

13. A well fluid sampling tool as claimed in claim 1, wherein the tool further comprises at least one or more sample inlet port.

14. A well fluid sampling tool as claimed in claim 13, wherein the tool further comprises at least one sample outlet port.

15. A well fluid sampling tool as claimed in claim 1, wherein the tool further comprises means for removing a sample from the sample chamber.

16. A well fluid sampling tool as claimed in claim 15, wherein the sample removal means includes first and second ports which communicate with first and second outer ends of the sample chamber.

17. A well fluid sampling tool as claimed in claim 15, further comprising first and second ports disposed such that, when a pump is connected across the first and second ports, a differential pressure is applied across first and second ends of the sample chamber, thereby effecting movement of the sample within the tool towards at least one sample outlet port.

18. A method of operating a well fluid sampling tool according to claim 1, the tool further comprising heater means in thermal communication with the sample chamber and means for controlling the heater means including means for measuring temperature external of the tool, the method comprising:

storing a preset temperature on the control means;

lowering the tool down a borehole;

continually monitoring the temperature external the tool at predetermined intervals;

comparing the measured external temperatures to the preset temperature and if the measured external temperature is greater than the preset temperature then causing the heater means to heat at least part of the sample chamber to the measured external temperature.

19. A method as claimed in claim 18, comprising the further step of continually monitoring the pressure external the tool.

20. A method as claimed in claim 19, comprising the further step of storing the highest external pressure monitored on the control means.

21. A method as claimed in claim 18, comprising the further step of providing the tool with an electronic clock circuit and a memory logger circuit.

22. A method of operating a well fluid sampling tool according to claim 1, the tool further comprising heater means in thermal communication with the sample chamber and means for controlling the heater means including means for measuring temperature external of the tool, the method comprising:

storing a preset temperature on the control means;

lowering the tool down a borehole;

continually monitoring the temperature external the tool at predetermined intervals;

comparing the measured external temperatures to the preset temperature and if the measured external temperature is greater than the preset temperature then causing the heater means to heat at least part of the sample chamber to the measured external temperature; and as the tool is lowered, determining if the external temperature is greater than the preset temperature and, if so, storing the external temperature as the preset temperature.

23. A well fluid sampling tool comprising a sample chamber at least partly surrounded by an at least partially evacuated jacket and a separate annular space, the sample chamber and separate annular space being separated by a tubular member, wherein the annular space is at least partly surrounded by the at least partially evacuated jacket, an outermost wall of the jacket being adjacent to or forming an outermost wall of the tool, wherein the evacuated jacket comprises first and second tubular bodies, the first tubular body comprising the outermost wall of the jacket and the second tubular body being disposed within the first tubular body, an evacuated chamber being disposed between the two bodies.

24. A well fluid sampling tool as claimed in claim 23, wherein the evacuated chamber is formed by a longitudinal annular space between the bodies.

25. A well fluid sampling tool as claimed in claim 24, wherein the pressure in the annular space is between approximately $10^{-7}$ PSI and $10^{-11}$ PSI.

26. A well fluid sampling tool as claimed in claim 25, wherein the pressure in the annular space is around $10^{-8}$ PSI.

27. A well fluid sampling tool as claimed in claim 23, wherein the first and second tubular bodies are formed in one piece, being joined at at least one end.

28. A well fluid sampling tool as claimed in claim 27, wherein the first and second tubular bodies are integrally connected to one another proximate respective first adjacent ends of each body.

29. A well fluid sampling tool as claimed in claim 28, further comprising an integral connection formed by welding.

30. A well fluid sampling tool as claimed in claim 29, wherein the integral connection is formed by e-beam welding.

31. A well fluid sampling tool as claimed in claim 23, wherein the sample chamber is disposed within a third tubular body which is at least partly disposed within the second tubular body, said annular space being defined between the third and second tubular bodies, wherein said third tubular body is the tubular member.

32. A well fluid sampling tool as claimed in claim 23, further comprising a third tubular body at least partially disposed within the second tubular body, and sample temperature maintenance means being disposed between the second and third tubular bodies.

33. A well fluid sampling tool as claimed in claim 32, wherein the temperature maintenance means include a plurality of heaters spaced longitudinally between the second and third tubular bodies.

34. A well fluid sampling tool as claimed in claim 33, wherein the plurality of heaters compensate for heat loss at their respective locations.

35. A well fluid sampling tool as claimed in claim 33, further comprising first and second heaters disposed at first and second ends of the third tubular body respectively which are more powerful than each of the heaters of the plurality of heaters.

36. A well fluid sampling tool as claimed in claim 35, wherein the second heater is more powerful than the first heater.

37. A well fluid sampling tool as claimed in claim 23, wherein the first and second tubular bodies are connected to one another proximate respective second adjacent ends of each body.

38. A well fluid sampling tool as claimed in claim 23, further comprising a centraliser disposed between the first and second bodies.

39. A well fluid sampling tool as claimed in claim 38, wherein the centraliser is made at least partly from titanium.

40. A well fluid sampling tool as claimed in claim 23, wherein the tool further comprises pressure relief means communicating between the sample chamber and external the tool such that, in use, if pressure in the chamber exceeds a predetermined level the pressure is relieved via the pressure relief means.

41. A well fluid sampling tool as claimed in claim 40, wherein the pressure relief means comprise a pressure relief valve or a breakable disc.

42. A well fluid sampling tool comprising a sample chamber at least partly surrounded by an at least partially evacuated jacket and a separate annular space, the sample chamber and separate annular space being separated by a tubular member, wherein the annular space is at least partly surrounded by the at least partially evacuated jacket, an outermost wall of the jacket being adjacent to or forming an outermost wall of the tool, wherein the temperature maintenance means further comprises at least one temperature sensor for detecting the temperature of the fluid sample, and wherein the at least one temperature sensor measures the temperature of an outer wall of the third tubular body.

43. A well fluid sampling method comprising the steps of:

providing a well fluid sampling tool having a sample chamber at least partly surrounded by an evacuated jacket and a separate annular space, the sample chamber and separate annular space being separated by a tubular member wherein the annular space is at least partly surrounded by the at least partially evacuated jacket, an outermost wall of the jacket being an outermost wall of the tool;

lowering the tool down a wellbore to a location where well fluid is to be sampled;

admitting a sample into the sample chamber by means of controllable admission means;

sealing the sample chamber;

retrieving the sample to surface while substantially maintaining the temperature of the sample;

removing the sample from the sample chamber into a chamber of a sample transfer vessel.

44. A method as claimed in claim 43, wherein the sample chamber has a predetermined volume.

45. A method as claimed in claim 43, comprising the further steps of, on admitting the sample into the sample chamber, measuring and storing temperature and pressure outside the tool.

46. A method of operating a well fluid sampling tool, the tool comprising a sample chamber, heater means in thermal communication with the sample chamber and means for controlling the heater means including means for measuring temperature external of the tool, the method comprising:

storing a preset temperature on the control means;

lowering the tool down a borehole;

continually monitoring the temperature external the tool at predetermined intervals;

comparing the measured external temperatures to the preset temperature and if the measured external temperature is greater than the preset temperature then causing the heater means to heat at least part of the sample chamber to the measured external temperature;

wherein the method further comprises the step of, as the tool is lowered determining if the external temperature is greater than the preset temperature and, if so, storing the external temperature as the preset temperature.

* * * * *